US006286271B1

(12) United States Patent
Kong

(10) Patent No.: US 6,286,271 B1
(45) Date of Patent: Sep. 11, 2001

(54) LOAD-BEARING STRUCTURAL MEMBER

(76) Inventor: Carl Cheung Tung Kong, 6122 Whittier Blvd., Los Angeles, CA (US) 90022

( * ) Notice: Subject to any disclaimer, the term of this patent is extended or adjusted under 35 U.S.C. 154(b) by 0 days.

(21) Appl. No.: 09/320,513

(22) Filed: May 26, 1999

(51) Int. Cl.[7] ..... E04B 1/98
(52) U.S. Cl. ..... 52/167.4
(58) Field of Search ..... 52/167.4, 167.1; 248/560, 562, 634, 575; 188/269, 266.1; 267/113

(56) References Cited

U.S. PATENT DOCUMENTS

| | | | | |
|---|---|---|---|---|
| D. 277,727 | | 2/1985 | Klaric . | |
| 3,459,395 | * | 8/1969 | Scotto | 248/562 X |
| 3,937,165 | | 2/1976 | Thivans . | |
| 4,020,132 | | 4/1977 | Calini . | |
| 4,043,693 | | 8/1977 | Brown . | |
| 4,047,256 | | 9/1977 | Hasara . | |
| 4,266,379 | * | 5/1981 | Aguelar | 52/167.4 X |
| 4,309,125 | | 1/1982 | Richardson . | |
| 4,589,157 | | 5/1986 | Richard . | |
| 4,619,096 | | 10/1986 | Lancelot, III . | |
| 4,638,983 | * | 1/1987 | Idiqkeit et al. | 248/562 X |
| 4,684,287 | | 8/1987 | Wojciechowski . | |
| 4,722,479 | | 2/1988 | Koob . | |
| 4,875,319 | | 10/1989 | Hobmann . | |
| 4,927,291 | | 5/1990 | Belangie . | |
| 5,024,554 | | 6/1991 | Benneywirth et al. . | |
| 5,072,474 | | 12/1991 | Dilger et al. . | |
| 5,083,404 | | 1/1992 | Schulte . | |
| 5,102,105 | * | 4/1992 | Hamaekers et al. | 248/562 X |
| 5,351,353 | | 10/1994 | Walters . | |
| 5,408,798 | | 4/1995 | Hohmann . | |
| 5,475,960 | | 12/1995 | Lindal . | |
| 5,513,927 | | 5/1996 | Baker et al. . | |
| 5,544,781 | | 8/1996 | Mattesky . | |
| 5,549,176 | | 8/1996 | Hawkins . | |
| 5,550,555 | | 8/1996 | Cottrell . | |
| 5,568,705 | | 10/1996 | Bellavista . | |
| 5,570,486 | | 11/1996 | Wiedeck . | |
| 5,573,088 | | 11/1996 | Daniels . | |
| 5,586,418 | | 12/1996 | Alander et al. . | |
| 5,593,245 | | 1/1997 | Herz et al. . | |
| 5,607,527 | | 3/1997 | Isley, Jr. . | |
| 5,645,773 | | 7/1997 | Ichikawn . | |
| 5,649,784 | | 7/1997 | Ricaud et al. . | |
| 5,653,099 | | 8/1997 | MacKenzie . | |
| 5,657,588 | | 8/1997 | Axon . | |
| 5,664,906 | | 9/1997 | Baker et al. . | |
| 5,671,578 | | 9/1997 | Hohmann . | |
| 5,678,374 | | 10/1997 | Fukuoka . | |
| 5,713,162 | | 2/1998 | Gallo et al. . | |
| 5,720,537 | | 2/1998 | Lutz . | |

* cited by examiner

*Primary Examiner*—Jerry Redman
(74) *Attorney, Agent, or Firm*—Kellu Bauersfeld Lowry & Kelley, LLP

(57) ABSTRACT

A load-bearing structural member is disposed between a selected base and a load bearing element and is capable of bearing loads of various magnitudes while granting flexibility and resiliency to a structure. The structural member includes a housing fixed to the base and having a resilient wall which defines an inner cavity and a first open end, a flexible partition joined to an inner surface of the wall adjacent to the first open end, a displaceable stiff closure member fitting within the first open end to define an inner fluid containing chamber between the cavity and the flexible partition, and a shaft interconnected between the closure member and the load bearing element. The load-bearing structural members may be interconnected and configured such to act as a support structure.

65 Claims, 7 Drawing Sheets

LOAD-BEARING STRUCTURAL MEMBER

BACKGROUND OF THE INVENTION

The present invention relates to load-bearing structures. More particularly, the present invention relates to a load-bearing structural member having a fluid chamber, which is capable of absorbing an applied load and, when the load is removed, returning the structure to its original configuration.

The types and varieties of load bearing structures are vast. Load bearing structures are commonly used in the framework and base construction of buildings, roads and bridges in order to not only support the weight of the structure and the loads placed thereon, but also to allow the structure to move somewhat due to thermal expansion, wind, earthquakes and other external forces. Load-bearing structures are also used in automobiles, submarines, and a myriad of other devices upon which load and pressure forces are applied.

In some devices, the use of flexible materials do not negatively affect the performance of the device. In others, strong, rigid materials must necessarily be used. The methods and materials used to create load bearing structures in buildings, roads and bridges have traditionally included the use of strong construction materials such as steel and reinforced concrete. As these materials allow limited flexibility, expansion spaces or members are typically employed. Oftentimes, resilient materials such as coils, elastomers and foams are used within the load-bearing structure. However, after a traumatic event, such as an earthquake, the resilient material may be crushed or otherwise damaged. These materials also tend to lose their resiliency due to the constant forces acting on them over time. The loss of resiliency causes the structure to remain in the displaced or compacted state instead of returning to its original configuration.

Therefore, what is needed is a load-bearing structural member which is capable of supporting a wide range of loads and then returning to its original state on removal of an applied load, even after a traumatic event. Such a load-bearing structural member is needed which will not lose its resiliency over time. The present invention fulfills these needs and provides other related advantages.

SUMMARY OF THE INVENTION

The present invention resides in a load-bearing structural member disposed between a selected base and a load bearing element, and which is capable of bearing forces from loads of various magnitudes while granting flexibility and resiliency to a structure. Generally, the load-bearing structural member comprises a housing fixed to the selected base and having a resilient wall defining an inner cavity and a first open end, a flexible partition joined to a surface of the resilient wall adjacent to the first open end, a displaceable closure member fitting within the first open end to define an inner fluid containing chamber between the cavity and the flexible partition, and a shaft interconnected between the closure member and the load bearing element. The flexible partition preferably comprises a low-friction elastomer, and several load-bearing structural members may be interconnected as needed for specific applications.

A load transmitted to the shaft via the load bearing element displaces the closure member and acts on the fluid within the inner chamber. The closure member is replaced to its original position when the contents of the fluid chamber reach a state of equilibrium. A port is formed through the housing wall in order to access the inner chamber. The fluid in the inner chamber may be comprised of a compressible gas or a liquid. When a liquid is placed in the chamber, the walls of the housing are deformably resilient to absorb applied loads. The fluid contents of the inner chamber may be under a negative pressure to create a vacuum-effect when the closure member is displaced away from the chamber, acting to pull the closure member back to its original position.

In one alternative form of the present invention the displaceable closure member includes an aperture over which the flexible partition is stretched to create a deformably resilient diaphragm. The diaphragm temporarily deforms through the aperture in reaction to the displacement of the closure member. When the load is removed, the diaphragm and the closure member return to their original positions.

In another form, the housing has a second open end in addition to the first open end and is constricted about a mid-portion. A second flexible partition is joined to an inner surface of the housing adjacent the second open end and a second shaft is interconnected between a load transmitting element and a second displaceable closure member fitting within the second open end. The inner fluid chamber extends between the opposing flexible partitions.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
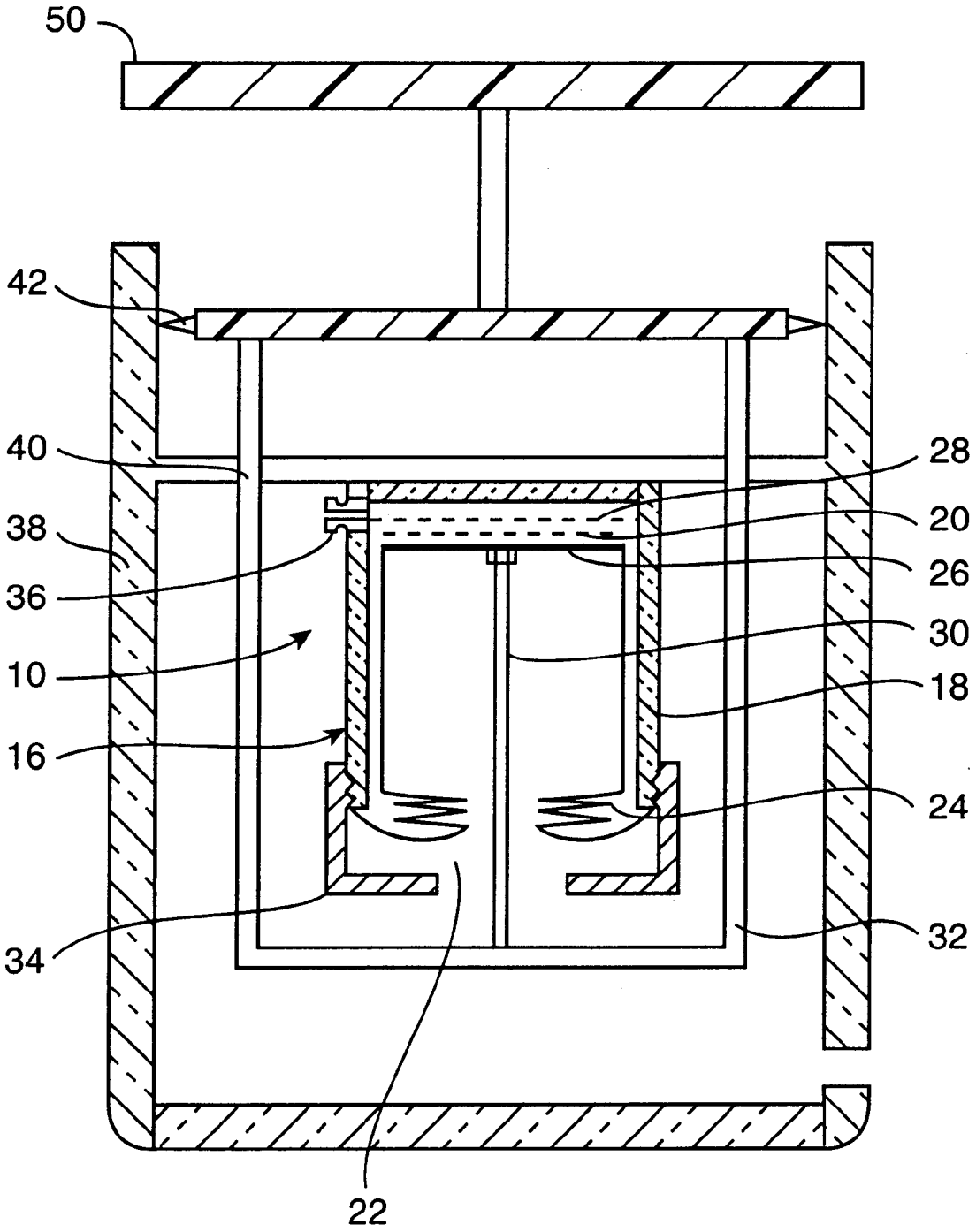
FIG. 1 is a cross-sectional view of a load-bearing structural member embodying the present invention disposed between a load transmitting element and a casing.
Figure 2:
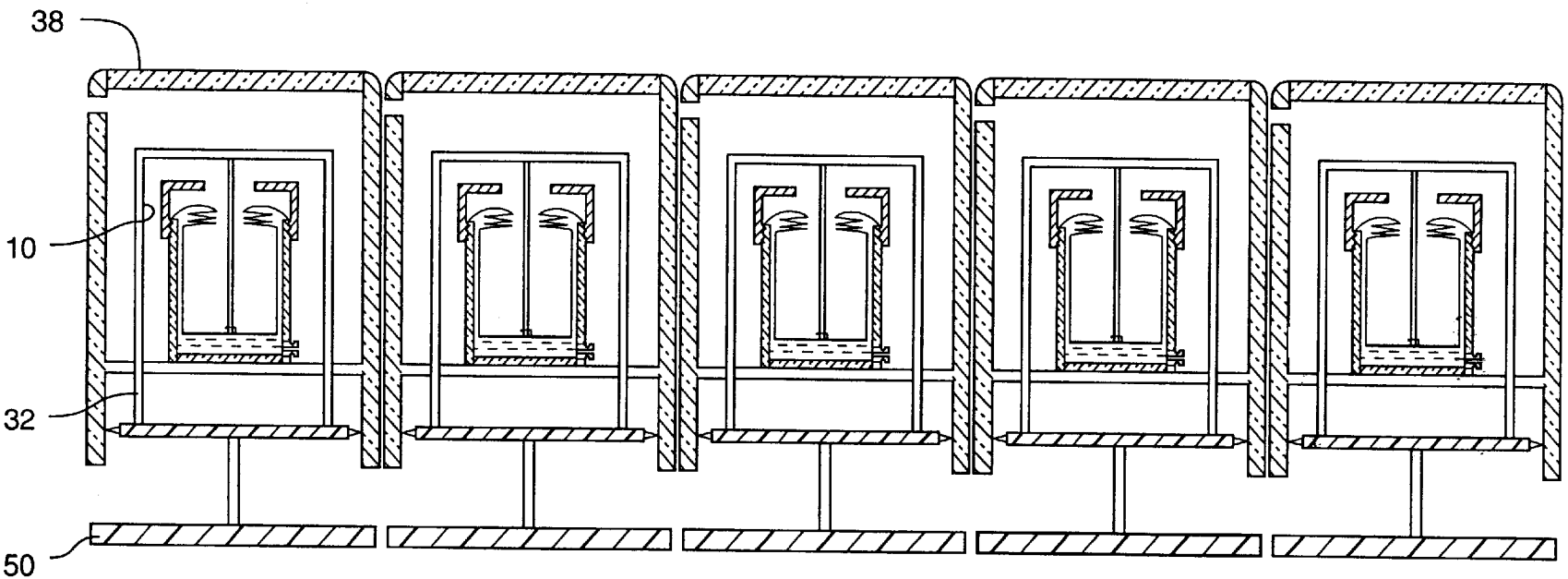
FIG. 2 is a cross-sectional view of multiple load-bearing structures of FIG. 1 attached side by side to form a structural support.
Figure 4:
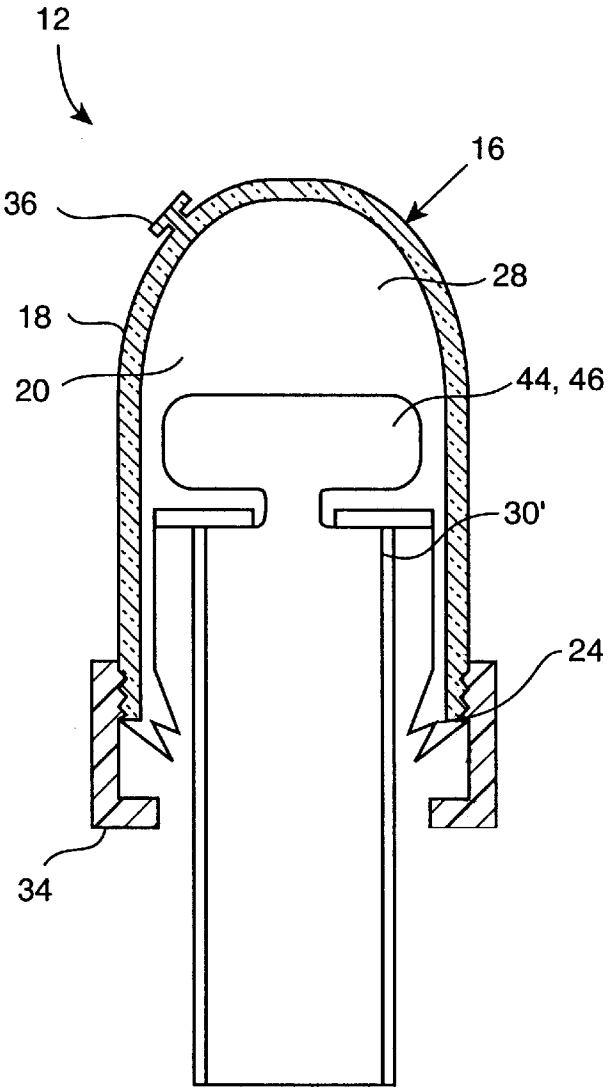
FIG. 4 is a cross-sectional view of the load-bearing structural member of FIG. 3, illustrating deformation of the diaphragm.
Figure 3:
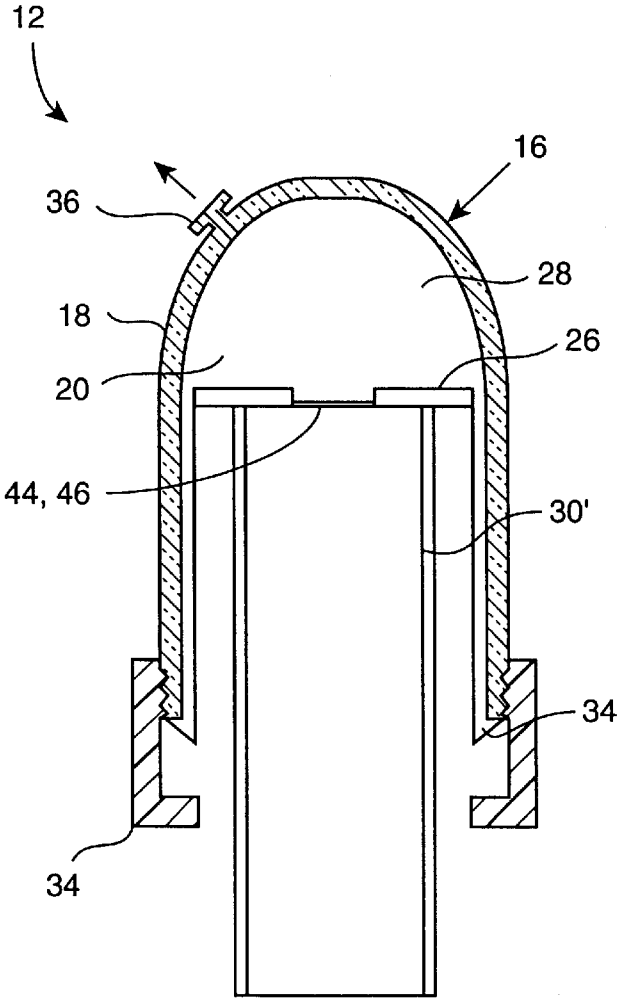
FIG. 3 is a cross-sectional view of another embodiment of the load-bearing structural member of the present invention, having a diaphragm stretched across an aperture of a closure member.

As shown in the drawings for purposes of illustration, the present invention is concerned with a load-bearing structural member, generally illustrated in FIGS. 1–2 and 7–8 by the reference number 10, in FIGS. 3 and 4 by the reference number 12, and in FIGS. 5–8 by the reference number 14. In the following description, functionally equivalent elements found in each of the illustrated embodiments will be given the same reference numbers.

The load-bearing structural members 10–14 each include a housing 16 having a wall 18 which defines an inner cavity 20 and an open end 22. The wall 18 may be comprised of a rigid, strong material such as steel, but is preferably comprised of a strong yet resilient material which can withstand the external forces applied to the structural member 10–14 while retaining its shape. A flexible partition 24 is joined to an inner surface of the wall 18 of the housing 16 near the open end 22. The flexible partition 24 is preferably comprised of a low-friction elastomer material. A displaceable rigid closure member 26 is fitted within the open end 22 under the flexible partition 24 to form an inner chamber 28 which typically contains a fluid between the flexible partition 24 and the cavity 20.

The fluid may be either a compressed gas or a liquid. The closure member 26 may be attached to the flexible partition 24. A shaft 30 is interconnected between the closure member 26 and a load bearing element 32. A stop 34 may be attached to or formed at the open end 22 of the housing 16 to limit the downward travel of the closure member 26. A port 36 is formed through the wall 18 of the housing 16 in order to gain access to the cavity 20 and inner fluid chamber 28. Preferably, the port 36 comprises a one-way valve for removing fluid from the chamber to allow greater movement of the shaft 30, closure member 26 and flexible partition 24. The port 36 may be used to create a negative pressure or a vacuum within the inner chamber 28 as necessary. The port 36 can be closed off to prevent the escape of fluid from the chamber 28 when in use. Several ports 36 may be formed in the wall 18 as needed.

The load-bearing structural member 10–14 may be very small or very large depending on its application and the magnitude of loads to be bom. When a load is applied to the load bearing element 32, the force of the load is transferred to the shaft 30 which displaces the closure member 26. The closure member 26 moves either towards or away from the inner fluid chamber 28 acting upon the fluid contents of the inner chamber 28.

When the inner fluid chamber 28 contains a compressible gas and the closure member 26 compresses the gas by moving towards the inner fluid chamber 28 in response to a load applied to the structural member 10–14, the compressed gas exerts a force on the displaceable closure member 26 urging it back to its original position. When the chamber is full of liquid, the liquid serves to act as a shock absorber. However, when the inner chamber 28 contains a liquid, the dosure member 26 is restricted in its displacement to the deformability of the resilient walls 18 comprising the housing 16 and/or the empty space remaining in the inner fluid chamber 28. In either event, the movable flexible partition 24 absorbs some of the force applied by moving either towards the wall 18 or collapsing upon itself within the chamber 28.

When the displaceable closure member 26 moves away from the inner fluid chamber 28 in response to a load exerted upon the shaft 30 through the load bearing element 32, a negative pressure is formed within the inner chamber 28 so as to cause the closure member 26 to be pulled back towards the inner chamber 28. This vacuum-effect is particularly acute when the inner fluid chamber 28 contains liquid. The effect is even more pronounced when the contents of the inner chamber 28 are placed under a negative pressure before any loads or forces are applied to the structural member 10–14.

A first embodiment of the load-bearing structural member 10 of the present invention is illustrated in FIGS. 1 and 2. The structural member 10 is disposed within a casing 38 which is attachable to the selected base. The selected base may take many forms of a structure or ground support such as end points of a bridge, the hull of a submarine, or the ground beneath a roadway, to name only a few. The housing 16 of the structural member 10 may be attached to the casing 38, or the walls 18 of the housing 16 may be formed with the casing 38 so as to comprise a wall of the housing 16. As illustrated in FIG. 1, the load transmitting element 32 typically attaches to the shaft 30 within the casing 38 and extends outside of the casing 38 through guide apertures 40.

The load bearing element 32 may also be stabilized with the use of a guide track into which guide members 42 move vertically. A platform 50 is preferably connected to the load bearing element 32 to more evenly spread the forces applied to the load bearing element 32. As illustrated in FIG. 2, the casings 38 may be joined together to form a surface support structure. Such a support structure would be particularly applicable where loads or forces are applied over a broad surface area.

Referring now to FIGS. 3 and 4, a second embodiment of the present invention is illustrated. In this particular embodiment, the closure member 26 of the structural member 12 has an aperture 44 through a central portion of the closure member 26. A flexible partition 24 comprised of a resiliently deformable material is stretched over the closure member 26, creating a diaphragm 46 over the closure member aperture 44. The shaft 30 is typically cylindrical in order to attach to and support the outer edges of the closure member 26. The contents of the inner fluid chamber 28 are preferably under a negative pressure. The shaft 30' moves in response to a load being applied to it, causing the closure member 26 to become displaced. The displacement of the closure member 26 in one vertical direction causes the diaphragm 46 to deform and expand through the aperture 44. As well as the compression and vacuum-effects on the contents of the fluid within the inner chamber 28 discussed above, the resiliency of the diaphragm 46 creates forces opposed to the forces acting upon the shaft 30'. These opposing forces counteract the load forces applied to the structural member 12 and replace the closure member 26 to its original position as the load acting on the shaft 30' is lessened. Although not shown, the housing 16 of this embodiment may be interconnected to others to form support structures.

Figure 5:
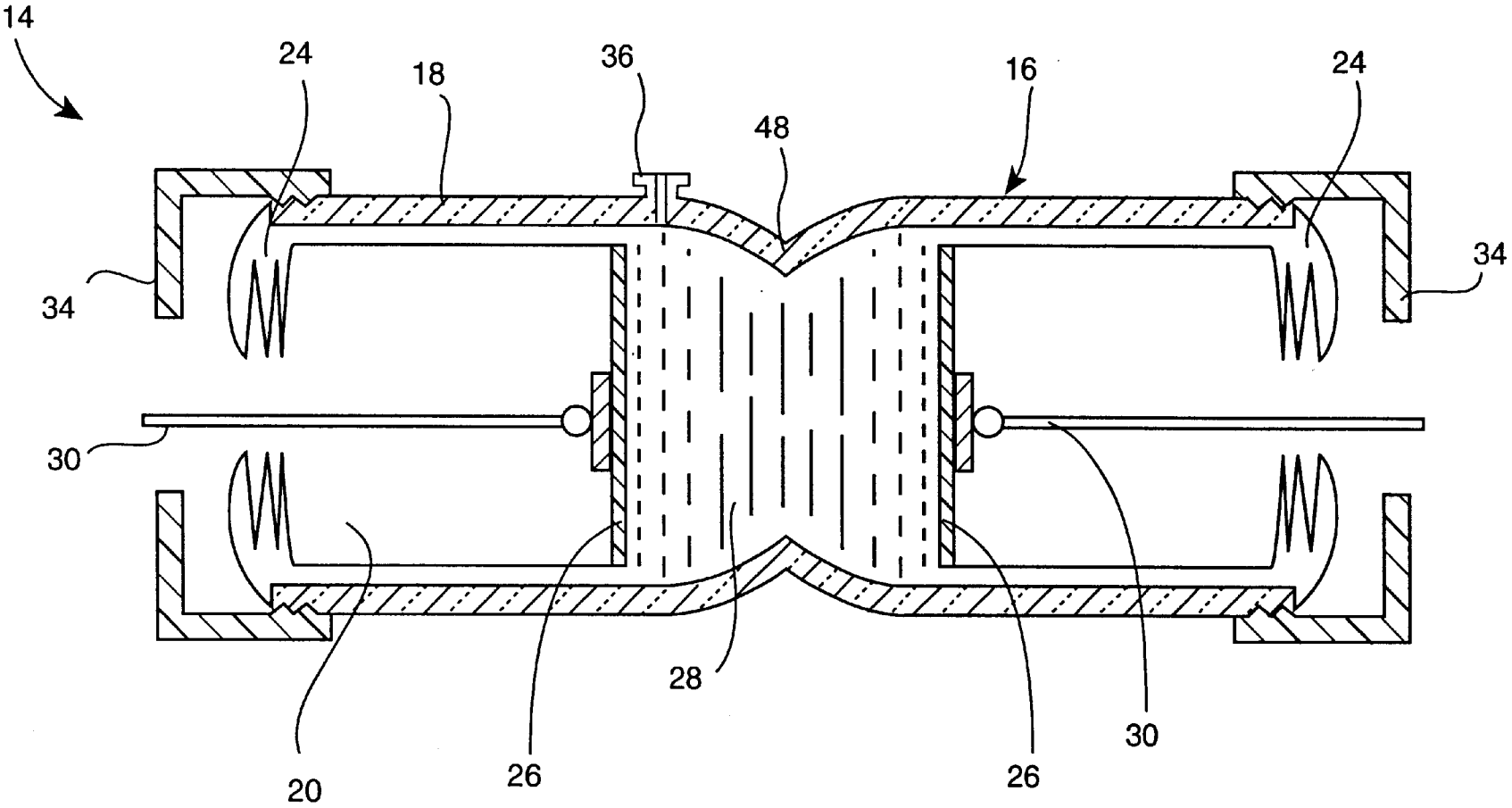
FIG. 5 is a cross-sectional view of another embodiment of the load-bearing structural member having two open ends.
Figure 6:
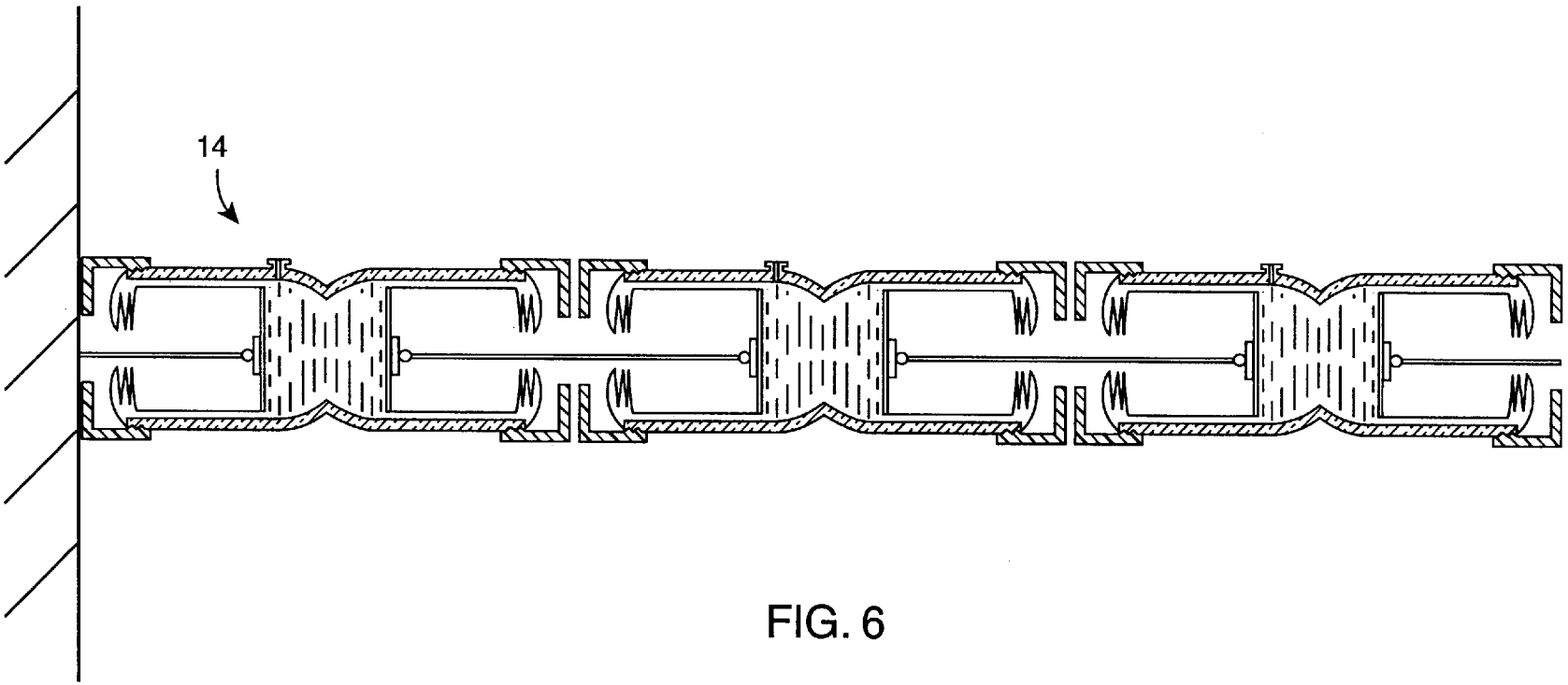
FIG. 6 is a cross-sectional view of multiple load-bearing structural members of FIG. 5 connected end to end to form a structural support.

A third embodiment of the present invention is shown in FIGS. 5 and 6. This form of the load-bearing structural member 14 has two open ends 22 and two flexible partitions 24 attached the inner surface of the wall 18 near each respective open end 22. Two closure members 26 are fitted within respective open ends so as to oppose one another, creating a inner fluid chamber 28 between the two flexible partitions 24 and the cavity 20 of the housing 16. The wall 18 of the housing 16 is conStdcted near the mid-portion of the housing 16. The constriction 48 acts as a barrier to prevent the closure members 26 from traveling past it. The restricted movement of the closure members 26 allows the vacuum-effect to be created when load forces initially push both closure members 26 in the same direction until one of the closure members 26 is stopped by the constriction 48 and the other closure member 26 continues to move away from the constriction 48. The constriction 48 also enhances the vacuum-effect when the closure members 26 are pulled away from each other, creating such a negative pressure as to replace both closure members 26 to their original positions. The flexibility or tightness of the attached structural members 14 can be controlled by altering the distance that the shaft 30 and closure member 26 are allowed to traverse. Travel is limited by increasing the negative pressure within the chamber 28.

Referring specifically now to FIG. 6, the housings 16 of the load-bearing structural members 14 may be connected end to end on a horizontal plane and interconnected to opposing vertical bases for lateral support. The connected structural members 14 may also be connected vertically end to end to create a pillar structural support member. Although the end to end connection mainly provides load bearing support in one plane, the deformably resilient walls 18 of the structural members 14 also provide a limited load beam support and flexibility in the other plane.

Figure 7:
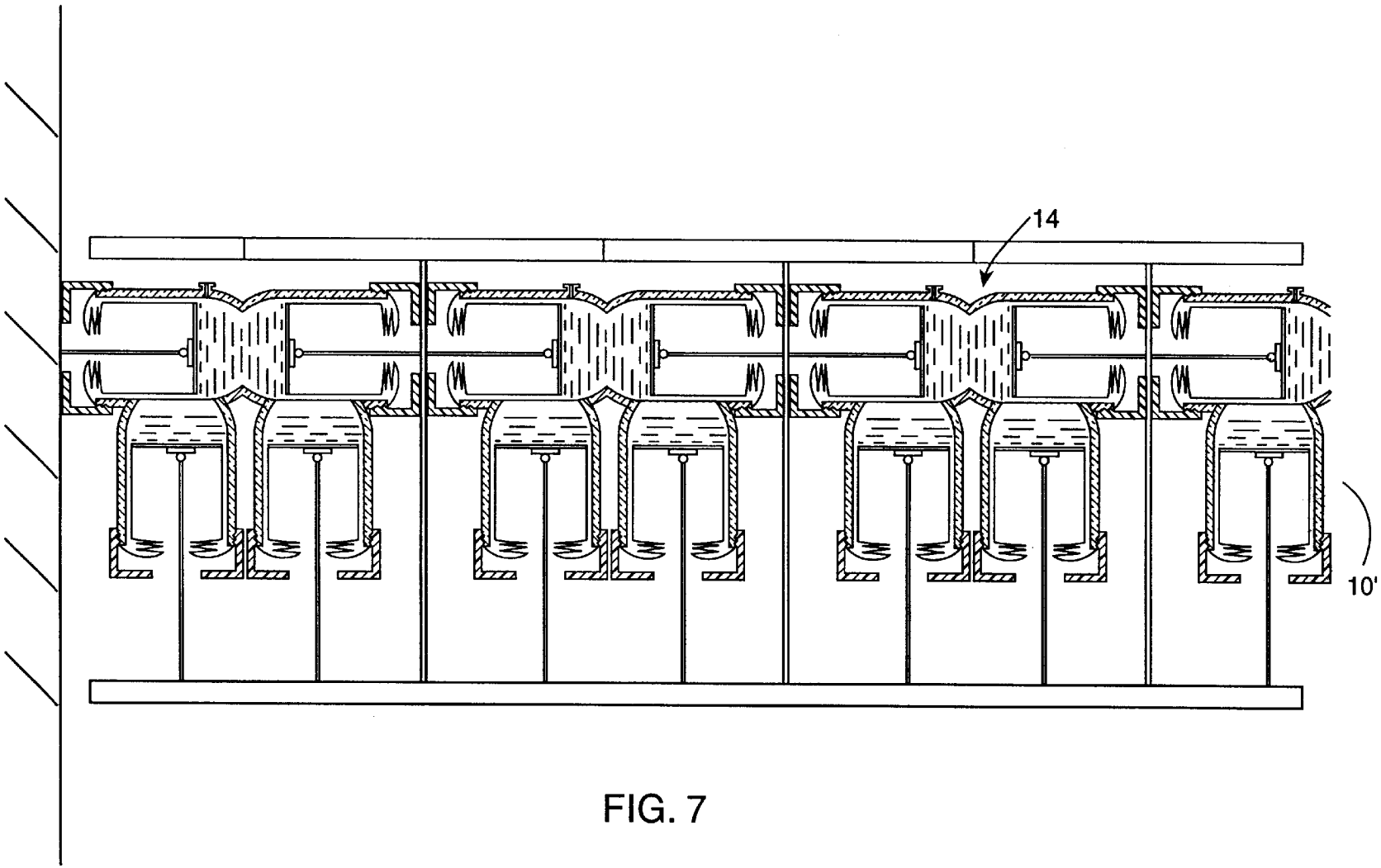
FIG. 7 is a cross-sectional view of multiple load-bearing structural members of FIG. 5 and modified load-bearing structural members of FIG. 1, connected to one another and configured to form a structural support for a closed-system bridge.
Figure 8:
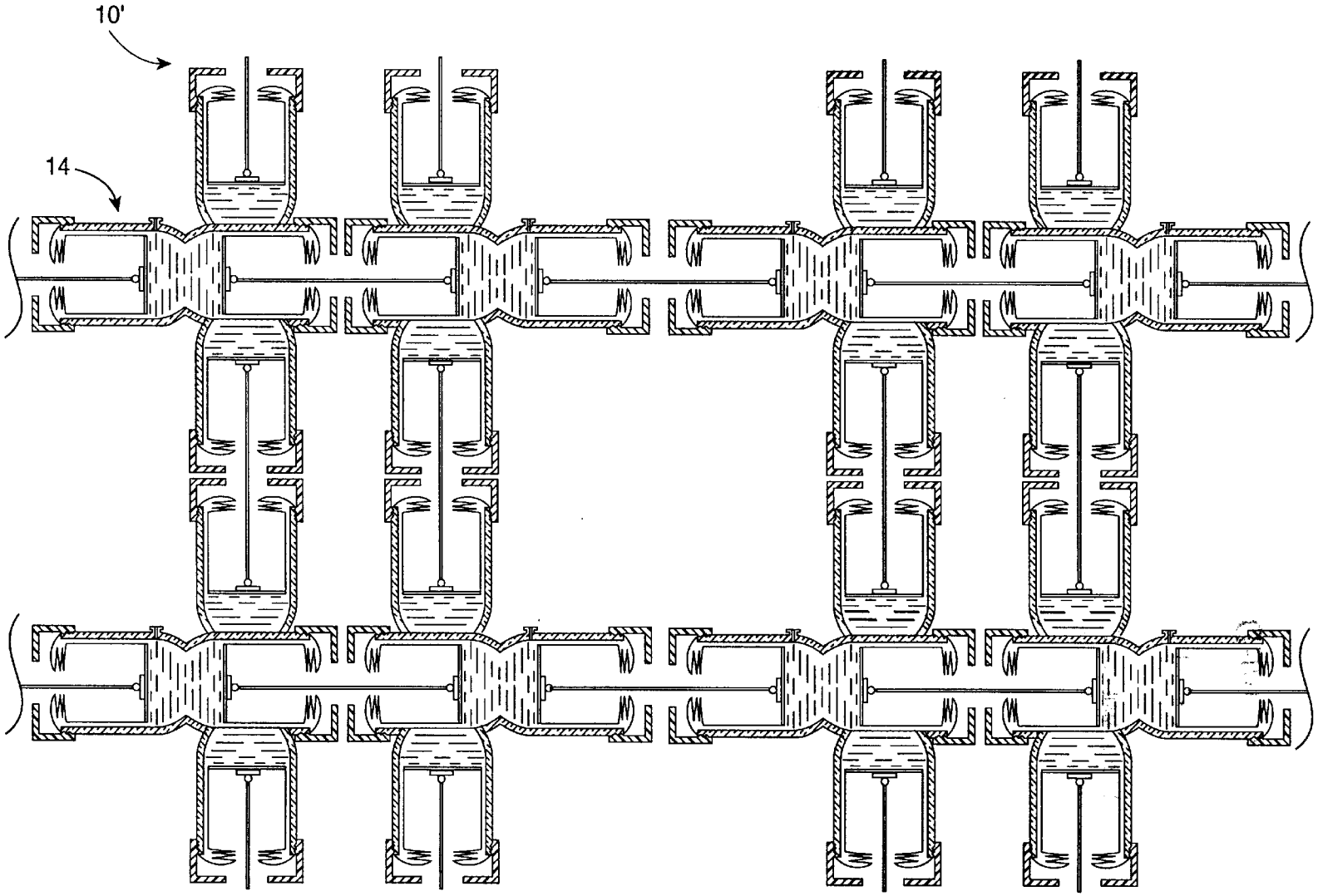
FIG. 8 is a cross-sectional view of multiple load-bearing structural members of FIG. 5 and modified load-bearing structural members of FIG. 1, connected to one another in a lattice configuration to form a structural support.

To enhance the load bearing support in both planes, a combination of the first and third structural members 10 and 14 having single and dual open ends, respectively, may be interconnected and configured to create a support structure such as the closed system bridge illustrated in FIG. 7. In fact, a lattice of connected load-bearing structural members 10–14 may be created, as illustrated in FIG. 8, in order to provide support from a variety of angles. Although several embodiments have been described in detail for purposes of illustration, various modifications may be made without departing from the spirit and scope of the invention. Accordingly, the invention is not to be limited, except as by the appended claims.

What is claimed is:

1. A load-bearing structural member disposed between a base and a load bearing element, comprising:

a housing fixed to the base and having a resilient wall that substantially defines an inner cavity, and a first open end;

a flexible partition joined to a surface of the resilient wall adjacent to the first open end;

a displaceable closure member fitting within the first open end of the housing to define an inner chamber containing compressible gas, between the cavity and flexible partition; and a shaft interconnected between the closure member and the load bearing element.

2. The load-bearing structural member of claim 1, wherein the flexible partition comprises a low-friction elastomer.

3. The load-bearing structural member of claim 1, wherein the wall of the housing is deformably resilient.

4. The load-bearing structural member of claim 1, wherein the contents of the inner chamber are under a negative pressure.

5. The load-bearing structural member of claim 4, wherein the displacement of the closure member away from the inner chamber creates a vacuum-effect which tends to pull the closure member back to its original position.

6. The load-bearing structural member of claim 1, wherein the housing includes a second open end opposed to the first open end, a second flexible partition joined to a surface of the housing adjacent the second open end, a second shaft interconnected between a second load bearing element and a second displaceable closure member fitting within the second open end, wherein the inner chamber extends between the flexible partitions.

7. The load-bearing structural member of claim 6, wherein the housing is constricted about a mid-portion.

8. The load-bearing structural member of claim 1, wherein the closure member includes an aperture over which the flexible partition is stretched.

9. The load-bearing structural member of claim 1, wherein the housing includes a port through which the inner chamber can be accessed.

10. The load-bearing structural member of claim 1, wherein the base comprises a load bearing structure.

11. A load-bearing structural member disposed between a base and a load bearing element, comprising:

a housing fixed to the base and having a resilient wall that substantially defines an inner cavity, and a first open end;

a flexible low-friction elastomer partition joined to an inner surface of the resilient wall adjacent to the first open end;

a displaceable stiff closure member fitting within the first open end of the housing to define an inner chamber containing compressible gas, between the cavity and flexible partition;

a port formed in the resilient wall for accessing the inner chamber; and a shaft interconnected between the stiff closure member and the load bearing element.

12. The load-bearing structural member of claim 11, wherein the wall of the housing is deformably resilient.

13. The load-bearing structural member of claim 11, wherein the contents of the inner chamber are under a negative pressure.

14. The load-bearing structural member of claim 13, wherein the displacement of the closure member away from the inner chamber creates a vacuum-effect which tends to pull the closure member back to its original position.

15. The load-bearing structural member of claim 11, wherein the housing includes a second open end opposed to the first open end, a second flexible partition joined to an inner surface of the housing adjacent the second open end, a second shaft interconnected between a second load bearing element and a second displaceable closure member fitting within the second open end, wherein the inner chamber extends between the flexible partitions.

16. The load-bearing structural member of claim 15, wherein the housing is constricted about a mid-portion.

17. The load-bearing structural member of claim 11, wherein the closure member includes an aperture over which the flexible partition is stretched.

18. A load-bearing structural member disposed between a base and a load bearing element, comprising:

a housing fixed to the base and having a resilient wall that substantially defines an inner cavity, and a first open end;

a flexible partition joined to a surface of the resilient wall adjacent to the first open end;

a displaceable closure member fitting within the first open end of the housing to define an inner chamber containing a fluid, between the cavity and flexible partition; and a shaft interconnected between the closure member and the load bearing element;

wherein the fluid contents of the inner chamber are under a negative pressure.

19. The load-bearing structural member of claim 18, wherein the flexible partition comprises a low-friction elastomer.

20. The load-bearing structural member of claim 18, wherein the fluid comprises a liquid.

21. The load-bearing structural member of claim 20, wherein the wall of the housing is deformably resilient.

22. The load-bearing structural member of claim 18, wherein the displacement of the closure member away from the inner chamber creates a vacuum-effect which tends to pull the closure member back to its original position.

23. The load-bearing structural member of claim 18, wherein the housing includes a second open end opposed to the first open end, a second flexible partition joined to a surface of the housing adjacent the second open end, a second shaft interconnected between a second load bearing element and a second displaceable closure member fitting within the second open end, wherein the inner fluid chamber extends between the flexible partitions.

24. The load-bearing structural member of claims 23, wherein the housing is constricted about a mid-portion.

25. The load-bearing structural member of claim 18, wherein the closure member includes an aperture over which the flexible partition is stretched.

26. The load-bearing structural member of claim 18, wherein the housing includes a port through which the inner chamber can be accessed.

27. The load-bearing structural member of claim 18, wherein the base comprises a load bearing structure.

28. A load-bearing structural member disposed between a base and a load bearing element, comprising:

a housing fixed to the base and having a resilient wall that substantially defines an inner cavity, and a first open end;

a flexible low-friction elastomer partition joined to an inner surface of the resilient wall adjacent to the first open end;

a displaceable stiff closure member fitting within the first open end of the housing to define an inner chamber containing a fluid, between the cavity and flexible partition;

a port formed in the resilient wall for accessing the inner fluid chamber; and a shaft interconnected between the stiff closure member and the load bearing element;

wherein the fluid contents of the inner chamber are under a negative pressure.

29. The load-bearing structural member of claim 28, wherein the fluid comprises a liquid.

30. The load-bearing structural member of claim 28, wherein the wall of the housing is deformably resilient.

31. The load-bearing structural member of claim 28, wherein the displacement of the closure member away from the inner chamber creates a vacuum-effect which tends to pull the closure member back to its original position.

32. The load-bearing structural member of claim 28, wherein the housing includes a second open end opposed to the first open end, a second flexible partition joined to an inner surface of the housing adjacent the second open end, a second shaft interconnected between a second load bearing element and a second displaceable closure member fitting within the second open end, wherein the inner fluid chamber extends between the flexible partitions.

33. The load-bearing structural member of claim 32, wherein the housing is constricted about a mid-portion.

34. The load-bearing structural member of claim 28, wherein the closure member includes an aperture over which the flexible partition is stretched.

35. A load-bearing structural member disposed between a base and a load bearing element, comprising:

a housing fixed to the base and having a resilient wall that substantially defines an inner cavity, a first open end, and a second open end opposed to the first open end;

a first flexible partition joined to a surface of the resilient wall adjacent to the first open end;

a second flexible partition joined to a surface of the housing adjacent to the second open end;

a first displaceable closure member fitting within the first open end of the housing to define an inner chamber containing a fluid, between the cavity and flexible partition;

a second displaceable closure member fitting within the second open end;

a first shaft interconnected between the first closure member and the load bearing element; and a second shaft interconnected between a second load bearing element and the second displaceable closure member, wherein the inner fluid chamber extends between the flexible partitions.

36. The load-bearing structural member of claim 35, wherein the flexible partitions comprise a low-friction elastomer.

37. The load-bearing structural member of claim 35, wherein the fluid comprises a liquid.

38. The load-bearing structural member of claim 37, wherein the wall of the housing is deformably resilient.

39. The load-bearing structural member of claim 35, wherein the housing is constricted about a mid-portion.

40. The load-bearing structural member of claim 37, wherein the first closure member includes an aperture over which the flexible partition is stretched.

41. The load-bearing structural member of claim 35, wherein the housing includes a port through which the inner chamber can be accessed.

42. The load-bearing structural member of claim 35, wherein the base comprises a load bearing structure.

43. A load-bearing structural member disposed between a base and a load bearing element, comprising:

a housing fixed to the base and having a resilient wall that substantially defines an inner cavity, a first open end, and a second open end opposed to the first open end;

a first flexible low friction elastomer partition joined to an inner surface of the resilient wall adjacent to the first open end;

a second flexible partition joined to a surface of the housing adjacent to the second open end;

a first displaceable stiff closure member fitting within the first open end of the housing to define an inner chamber containing a fluid, between the cavity and flexible partition;

a second displaceable closure member fitting with the second open end;

a port formed in the resilient wall for accessing the inner fluid chamber; and a first shaft interconnected between the first stiff closure member and the load bearing element; and a second shaft interconnected between a second load bearing element and the second displaceable closure member, wherein the inner fluid chamber extends between the flexible partitions.

44. The load-bearing structural member of claim 43, wherein the fluid comprises a liquid.

45. The load-bearing structural member of claim 43, wherein the wall of the housing is deformably resilient.

46. The load-bearing structural member of claim 43, wherein the housing is constricted about a mid-portion.

47. The load-bearing structural member of claim 43, wherein the first closure member includes an aperture over which the first flexible partition is stretched.

48. A load-bearing structural member disposed between a base and a load bearing element, comprising:

a housing fixed to the base and having a resilient wall that substantially defines an inner cavity, and a first open end;

a flexible partition joined to a surface of the resilient wall adjacent to the first open end;

a displaceable closure member rfiting within the first open end of the housing to define an inner chamber containing a fluid, between the cavity and flexible partition, the closure member including an aperture over which the flexible partition is stretched; and a shaft interconnected between the closure member and the load bearing element.

49. The load-bearing structural member of claim 48, wherein the flexible partition comprises a low-friction elastomer.

50. The load-bearing structural member of claim 48, wherein the fluid comprises a liquid.

51. The load-bearing structural member of claim 50, wherein the wall of the housing is deformably resilient.

52. The load-bearing structural member of claim 48, wherein the housing includes a port through which the inner chamber can be accessed.

53. The load-bearing structural member of claim 48, wherein the base comprises a load bearing structure.

54. A load-bearing structural member disposed between a base and a load bearing element, comprising:

a housing fixed to the base and having a resilient wall that substantially defines an inner cavity, and a first open end;

a flexible low fricton elastomer partition joined to an inner surface of the resilient wall adjacent to the first open end;

a displaceable stiff closure member fiotin9 within the first open end of the housing to define an inner chamber containing a fluid, between the cavity and flexible partition;

a port formed in the resilient wall for accessing the inner fluid chamber; and a shaft interconnected between the stiff closure member and the load bearing element, wherein the housing is constricted about a mid-portion.

55. The load-bearing structural member of claim 54, wherein the fluid comprises a liquid.

56. The load-beating structural member of claim 54, wherein the wall of the housing is deformably resilient.

57. The load-bearing structural member of claim 54, wherein the closure member includes an aperture over which the flexible partition is stretched.

58. A load-bearing structural member disposed between a base and a load bearing element, comprising:

a housing fixed to the base and having a resilient wall that substantially defines an inner cavity, and a first open end;

a flexible partition joined to a surface of the resilient wall adjacent to the first open end;

a displaceable closure member fitting within the first open end of the housing to define an inner chamber containing a fluid, between the cavity and flexible partition; and a shaft interconnected between the closure member and the load bearing element, wherein the housing includes a port through which the inner chamber can be accessed.

59. The load-bearing structural member of claim 58, wherein the flexible partition comprises a low-friction elastomer.

60. The load-bearing structural member of claim 58, wherein the fluid comprises a liquid.

61. The load-bearing structural member of claim 60, wherein the wall of the housing is deformably resilient.

62. The load-bearing structural member of claim 58, wherein the base comprises a load bearing structure.

63. A load-bearing structural member disposed between a base and a load bearing element, comprising:

a housing fixed to the base and having a resilient wall that substantially defines an inner cavity, and a first open end;

a flexible low-friction elastomer partition joined to an inner surface of the resilient wall adjacent to the first open end;

a displaceable stiff closure member fitting within the first open end of the housing to define an inner chamber containing a fluid, between the cavity and flexible partition, the closure member including an aperture over which the flexible partition is stretched;

a port formed in the resilient wall for accessing the inner fluid chamber; and a shaft interconnected between the stiff closure member and the load bearing element.

64. The load-bearing structural member of claim 63, wherein the fluid comprises a liquid.

65. The load-bearing structural member of claim 63, wherein the wall of the housing is deformably resilient.

* * * * *

UNITED STATES PATENT AND TRADEMARK OFFICE

CERTIFICATE OF CORRECTION

PATENT NO. : 6,286,271 B1
DATED : September 11, 2001
INVENTOR(S) : Carl Cheung Tung Kong It is certified that error appears in the above-identified patent and that said Letters Patent is hereby corrected as shown below:

Claim 40,
Line 1, replace "37" with -- 35 --.

Claim 48,
Line 8, replace "rfiting" with -- fitting --.

Claim 54,
Line 6, replace "low fricton" with -- low-friction --.
Line 9, replace "fiotin9" with -- fitting --.

Claim 56,
Line 1, replace "load-beating" with -- load bearing --.

Signed and Sealed this

Twelfth Day of March, 2002

*Attest:*

*Attesting Officer*

JAMES E. ROGAN
*Director of the United States Patent and Trademark Office*